US006382322B1

(12) United States Patent
Gipson

(10) Patent No.: US 6,382,322 B1
(45) Date of Patent: May 7, 2002

(54) ROLLERS FOR TUBING INJECTORS

(75) Inventor: Tommie C. Gipson, Eastland, TX (US)

(73) Assignee: Coiled Tubing Solutions, Inc., Eastland, TX (US)

( * ) Notice: Subject to any disclaimer, the term of this patent is extended or adjusted under 35 U.S.C. 154(b) by 0 days.

(21) Appl. No.: 09/977,784

(22) Filed: Oct. 15, 2001

Related U.S. Application Data

(60) Provisional application No. 60/316,007, filed on Aug. 30, 2001, and provisional application No. 60/304,681, filed on Jul. 11, 2001.

(51) Int. Cl.[7] ..... E21B 19/00

(52) U.S. Cl. ..... 166/379; 166/384; 166/77.2; 166/85.5; 166/242.2

(58) Field of Search ..... 166/384, 379, 166/55, 77.1, 77.2, 85.5, 242.2

(56) References Cited

U.S. PATENT DOCUMENTS 5,188,174 A * 2/1993 Anderson et al.
5,799,731 A * 9/1998 Avakov et al.
5,803,168 A * 9/1998 Lormand et al.
5,845,708 A * 12/1998 Burge et al.
5,890,534 A * 4/1999 Burge et al.

* cited by examiner

*Primary Examiner*—Roger Schoeppel
(74) *Attorney, Agent, or Firm*—Elizabeth R. Hall

(57) ABSTRACT

A means and method for supporting and applying transverse loads to coiled tubing during its injection into and withdrawal from a well by using novel rollers having coaxial segmented arcuate faces. The arcuate faces have arcs with the same radius as that of the tubing to be supported and are mutually concentric, but are independently rotatable. The novel rollers may be both driven and undriven.

20 Claims, 9 Drawing Sheets

ROLLERS FOR TUBING INJECTORS

CROSS REFERENCE TO RELATED APPLICATIONS

The present application, pursuant to 35 U.S.C. 111(b), claims the benefit of the earlier filing date of provisional application Serial No. 60/316,007 filed Aug. 30, 2001, and entitled "Improved Rollers for Coiled Tubing Injectors." The present invention is also related to another provisional Patent Application Serial No. 60/304,681 filed Jul. 11, 2001 entitled "Coiled Tubing Injector Utilizing Opposed Drive Modules and Having an Integral Bender."

FIELD OF THE INVENTION

The present invention relates to a method and apparatus for contacting and Supporting coiled tubing during its injection into and withdrawal from a well bore. More particularly, the invention relates to drive rollers having a central driven arcuate wheel and multiple idler tires mounted on either side of the central driven wheel. The idler tires have arcuate surfaces with the same diameter as the driven wheel surface and concentric with the arcuate surface of the central driven wheel, thereby supporting the tubing over a large arc without causing severe rubbing from differential motion between the wheel assembly and the tubing.

BACKGROUND OF THE INVENTION

Devices and methods for injecting coiled tubing into and retrieving it from wells are well known. Prior art coiled tubing injection systems include U.S. Pat. Nos. 6,142,406; 5,842,530; 5,839,514; 5,553,668; 5,309,990; 5,244,046; 5,234,053; 5,188,174; 5,094,340; 4,899,823; 4,673,035; 4,655,291; 4,585,061; and many other similar disclosures. In the prior art an injector at the wellhead is used to grip and control the injection and withdrawal of the tubing.

Conventional track injectors utilize gripper blocks mounted on two continuous parallel and opposed conveyor chains which are urged or pushed against the outer surface of the tubing. The interface forces between the gripper blocks and the tubing permit developing frictional forces which are used to transfer tangential loads from the conveyor chains to the tubing and vice versa. If insufficient interface force is applied to the tubing by the gripper blocks, slippage with attendant loss of control and wear occurs between the blocks and tubing. If excessive interface force is applied to the tubing by the gripper blocks, the tubing wall may be distorted and damaged or the injector may be damaged. A problem with such tracks results when the track is rotated into or out of engagement with the tubing from the sprockets at the ends of the track mounting assembly. This rotation can cause differential movement between the track and the tubing in the direction of the tubing axis so that rubbing occurs. As used in this description, the term "rubbing" represents any of the effects induced by metal pieces moving relative to each other when in contact, such as galling, abrasion, tearing, scrubbing, or skidding. Rubbing causes undesirable wear of both the tubing and the gripper blocks.

Historically, the approach used to increase the injection forces with conventional track injectors has been to lengthen the injector while maintaining a sufficiently safe interface force between the individual gripper blocks and the tubing. U.S. Pat. No. 5,842,530 for example shows provision of substantially more gripper blocks along the length of its injector.

Other injectors utilizing two continuous, parallel, and opposing track injectors having grooved shoes or blocks mounted thereon are known in the art. These opposing track units have facing portions where the multiplicity of gripping blocks run parallel for gripping the tubing therebetween and are typically positioned in line, directly adjacent and above the wellhead.

Another approach has been to utilize a large diameter driven wheel with an annularly grooved outer diameter to conform to and support the tubing. Relatively small-diameter hold-down idler rollers radially press the tubing against the wheel to provide extra interface force between the tubing and the wheel so that high tangential frictional forces can be imparted to the tubing by the wheel without maintaining large back tensions. These hold-down rollers have arcuate faces to match the tubing, but pronounced rubbing occurs between the tubing and the roller due to differential movement at different rotational diameters of the roller face. While the mechanism of wheel type injectors is simple, inexpensive, and reliable, wheel size can be a limitation, especially for larger tubing diameters. One such wheel type injector is disclosed in U.S. Pat. No. 5,839,514.

A more recent injector system known in the art is a linear injector which pulls on only one side of the tubing. For this type of device, coiled tubing is driven along a single linear section of an endless chain conveyor with an opposing linear array of small-diameter arcuate face hold-down idler rollers. These hold-down rollers are sized to conform to the tubing, but they as a result cause the previously mentioned differential rubbing motion between the tubing and the roller face. Such a linear or one-track injector eliminates the necessity of synchronizing the two opposed sides of a conventional track type injector and is less damaging to the surface of the coiled tubing, but it requires a much longer unit, which of necessity extends much higher and requires additional overhead clearance. Additionally, such an injector is more expensive because it requires a considerable number of gripper blocks and rollers and a longer support track.

Copending U.S. Provisional Patent Application "Coiled Tubing Injector Utilizing Opposed Drive Modules and Having an Integral Bender", filed Jul. 11, 2001, utilizes a novel approach to imparting tangential injection forces to the tubing. That invention provides support over a larger portion of the tubing circumference by the driving means around the circumference of the tubing. By using a plurality of sets of opposed individually driven annularly grooved rollers which closely conform to the tubing and alternating the orientations of adjacent roller sets so that they are 90° apart about the through axis of the injector, excellent tubing support is provided. That invention is light weight, compact, easy to service and changeout for different tubing sizes, low cost, and efficient. However, the small-diameter arcuate rollers of this device exhibit the same undesirable rubbing action between the roller face and the tubing as the previously mentioned injectors.

A major problem with tubing injectors of all types is differential movement between the tubing and the portion of the injector mechanism which contacts the tubing. For instance, for opposed track type machines, when the drive chain carrying the gripper blocks has a link coming off of or entering onto the sprockets of the track drive, differential motion relative to the axis of the tubing occurs as a result of the difference in rotational radii for the surface of the support groove of the rotating gripper block. This differential motion results in an axial direction rubbing of the tubing surface which results in wear of both the contact block and the tubing. While this situation also exists for the large drive wheel of wheel type injectors, rubbing due to the small difference in circumferential speed at the different radii of the tubing support blocks is small enough to not be important for the wheel. This, however, is not the case for any small-diameter hold-down rollers used with either wheel-type injectors or linear injectors. Similarly, for the simple small-diameter arcuate drive rollers used in the copending U.S. Patent Application for "Coiled Tubing Injector Utilizing Opposed Drive Modules and Having an Integral Bender," rubbing becomes more significant when the supporting arc of the drive roller is increased to provide more tubing support.

Elimination or minimization of the rubbing between the drive and hold-down rollers and the tubing in tubing injectors utilizing small diameter wheels is desirable for reducing both wheel and tubing wear. Minimizing such rubbing is particularly difficult when it is desirable to provide support for the tubing over a large arcuate surface in order to minimize tubing ovaling under the action of lateral loads. A significant need exists for improvements which will permit simultaneously minimizing the erosive action of rubbing and maximizing tubing support.

SUMMARY OF THE INVENTION

The present invention utilizes a novel means and method for improving the injecting of coiled tubing into and from a well by reducing the rubbing action of arcuate wheels or rollers used to guide and react against the tubing. Several embodiments are multi-tired idler rollers applicable to most types of injectors. The third embodiment is a multi-tired driven roller which is also applicable to most types of injectors, but is particularly useful in conjunction with the linear mechanical injector described in copending U.S. Provisional Patent Application "Coiled Tubing Injector Utilizing Opposed Drive Modules and Having an Integral Bender" that is hereby incorporated by reference herein.

The embodiments of the present invention provide improved circumferential support to the tubing which they contact by supporting the tubing over a substantially longer arcuate surface than is used for other types of arcuate rollers. This increase of circumferential support thereby helps to minimize permanent ovaling of the tubing under the action of lateral forces. The deleterious differential rubbing in the tubing axial direction between the roller and the tubing which would normally result from using a longer wheel arc is minimized by segmenting the arc of the wheel into multiple independently rotating elements. By minimizing the difference between the maximum and minimum rotational diameters contacting the tubing of a wheel element, the differential movement of the contacting arcuate surfaces of the rotating element is minimized. This method and apparatus for providing additional support for the tubing by using roller assemblies consisting of multiple independent coaxial rollers having concentric arcuate contact surfaces of the same diameter markedly reduces the tubing and roller or wheel rubbing which normally occurs with grooved rollers having small diameters relative to the tubing.

When the rollers of the present invention are utilized to develop traction on the tubing in the linear mechanical injector described in copending U.S. Provisional patent application "Coiled Tubing Injector Utilizing Opposed Drive Modules and Having an Integral Bender," the traction unit of that injector relies upon an array of multiple opposed pairs of annularly arcuately grooved driven roller assemblies which are urged into contact with the tubing. The pairs of roller assemblies are mounted in an alternating pattern 90° apart so that the tubing is well supported and urged into roundness. The arcuate surfaces of the driven roller assemblies are sized to closely conform to the nominal circular cross-section of the tubing. The driven roller assemblies consist of the drive rollers and coaxial mirror-image idler rollers on each side of the tubing contact portion of the drive roller. The arcuate surfaces of each of the drive rollers and their associated idler rollers have concentric arcs of the same diameter.

One aspect of the present invention is a roller assembly for supporting and applying transverse loads to tubing during its injection into and withdrawal from a wellbore. This roller assembly comprises: a central roller having a primary circumferential groove with a circularly arcuate cross-section; a first outer roller having a secondary circumferential groove with a circularly arcuate cross-section on an inner side of the external diameter of the first outer roller where the grooved surface is adjacent a first side of the central roller; and a second outer roller having a tertiary circumferential groove with a circularly arcuate cross-section on an inner side of the external diameter of the second outer roller where the grooved surface is adjacent a first side of the central roller; wherein the central roller and the first and second outer rollers are independently rotatable coaxial rollers, the primary, secondary and tertiary grooved surfaces having the same arc diameter and being mutually concentric to form a substantially continuous circularly arcuate tubing contact surface. The circularly arcuate tubing contact surface of the roller assembly comprises a primary groove surface that extends about 60° and a secondary and tertiary surfaces that extent on each side of the primary groove from about 30° to 40°.

Another aspect of the invention is an apparatus for supporting and applying transverse loads to coiled tubing during its injection into and withdrawal from a wellbore. The apparatus comprises: a central roller having a first and second mirror-image cylindrical outer rollers, the first and second outer rollers having respectively a secondary and tertiary circumferential groove with a circularly arcuate cross-section on a internal side of an outer diameter of said first and second outer rollers, one outer roller situated on each side of the central roller with the internal side facing the central roller and having a small clearance gap between the central roller and the outside rollers; wherein the central roller and the outer rollers are independently rotatable coaxial rollers, the primary, secondary and tertiary grooves having substantially equal arc diameters and being mutually concentric to form a substantially continuous circularly arcuate tubing contact surface; whereby when coiled tubing is placed in the circularly arcuate tubing contact surface, the movement of the coiled tubing will independently rotate the central and outer rollers. The apparatus may comprise a central non-rotating shaft passing through a through-bore in the central roller and the outer rollers, wherein the independently rotatable central roller and outer rollers are supported by the shaft and rotate about said shaft; or the apparatus may comprise a central rotating shaft passing through a through-bore in the central roller and the outer rollers, wherein the central roller is integral with the rotatable shaft and rotates with the rotatable shaft and the outer rollers are independently rotatable about the rotatable shaft.

Yet another aspect of the invention is a method for supporting and applying transverse and longitudinal loads to coiled tubing during its injection into and withdrawal from a wellbore. This method comprises the following steps: (a) feeding a coiled tubing through a functional path of a coiled tubing injector such that the coiled tubing is in contact with a plurality of roller assemblies. Each roller assembly having a central roller having a primary circumferential groove with a circularly arcuate cross-section, a first outer roller having an exposed secondary circumferential groove with a circularly arcuate cross-section on an inner side of said first outer roller where the secondary groove is adjacent a first side of the central roller; and a second outer roller having an exposed tertiary circumferential groove with a circularly arcuate cross-section on an inner side of the second outer roller where the tertiary groove is adjacent a second side of the central roller; wherein the central roller and the first and second outer rollers are independently rotatable coaxial rollers, the primary, secondary and tertiary grooves having the same arc diameter and being mutually concentric to form a substantially continuous circularly arcuate tubing contact surface; and (b) operating the coiled tubing injector to cause the roller assemblies to bear transversely on the coiled tubing so that tangential friction is developed between said rollers and the tubing, thereby permitting longitudinal driving forces to be transferred from the rollers to the tubing when the central rollers of the roller assemblies are rotationally driven; whereby when the coiled tubing moves by the circularly arcuate tubing contact surface the tangential friction between the rollers and the tubing cause the rollers to independently rotate.

The foregoing has outlined rather broadly several aspects of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed might be readily utilized as a basis for modifying or redesigning the structures for carrying out the same purposes as the invention. It should be realized by those skilled in the art that such equivalent constructions do not depart from the spirit and scope of the invention as set forth in the appended claims.

BRIEF DESCRIPTION OF THE DRAWINGS

The novel features which are believed to be characteristic of the invention, both as to its organization and methods of operation, together with the objects and advantages thereof, will be better understood from the following description taken in conjunction with the accompanying drawings, wherein.

DETAILED DESCRIPTION OF THE PREFERRED EMBODIMENT

Figure 1:
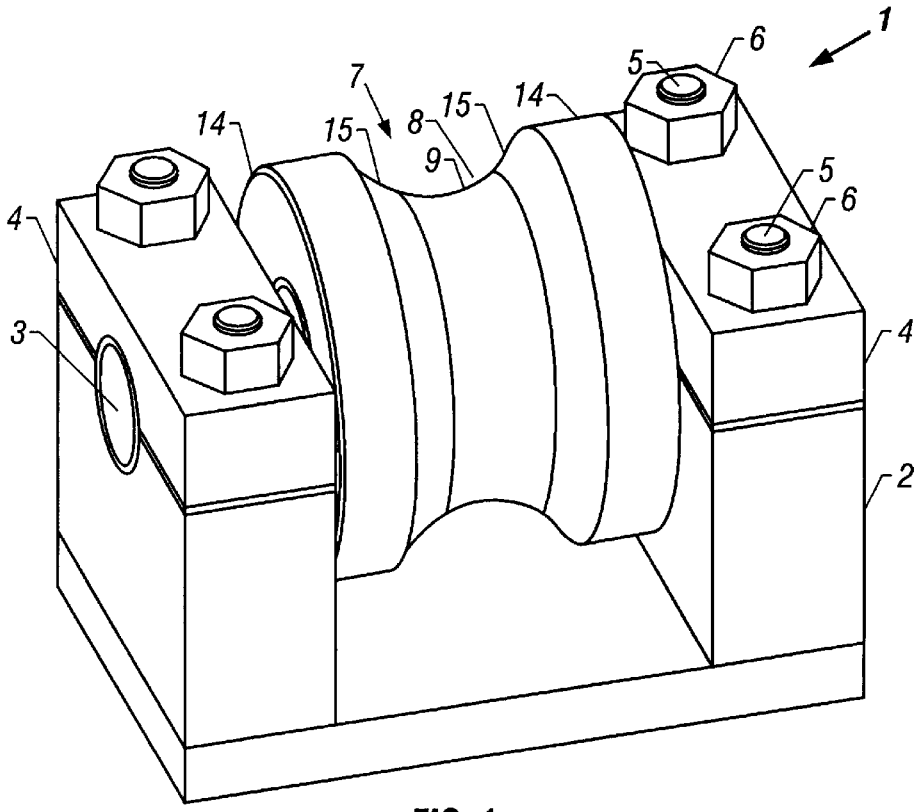
FIG. 1 is an oblique view of one embodiment of an idler roller with independently rotating center tire and two flanking outside tires mounted on a dead shaft.

Referring now to the drawings and initially to FIG. 1, it is pointed out that like reference characters designate like or similar parts throughout the drawings. The Figures, or drawings, are not intended to be to scale. For example, purely for the sake of greater clarity in the drawings, wall thickness and spacing are not dimensioned as they actually exist in the assembled embodiment.

Figure 2:
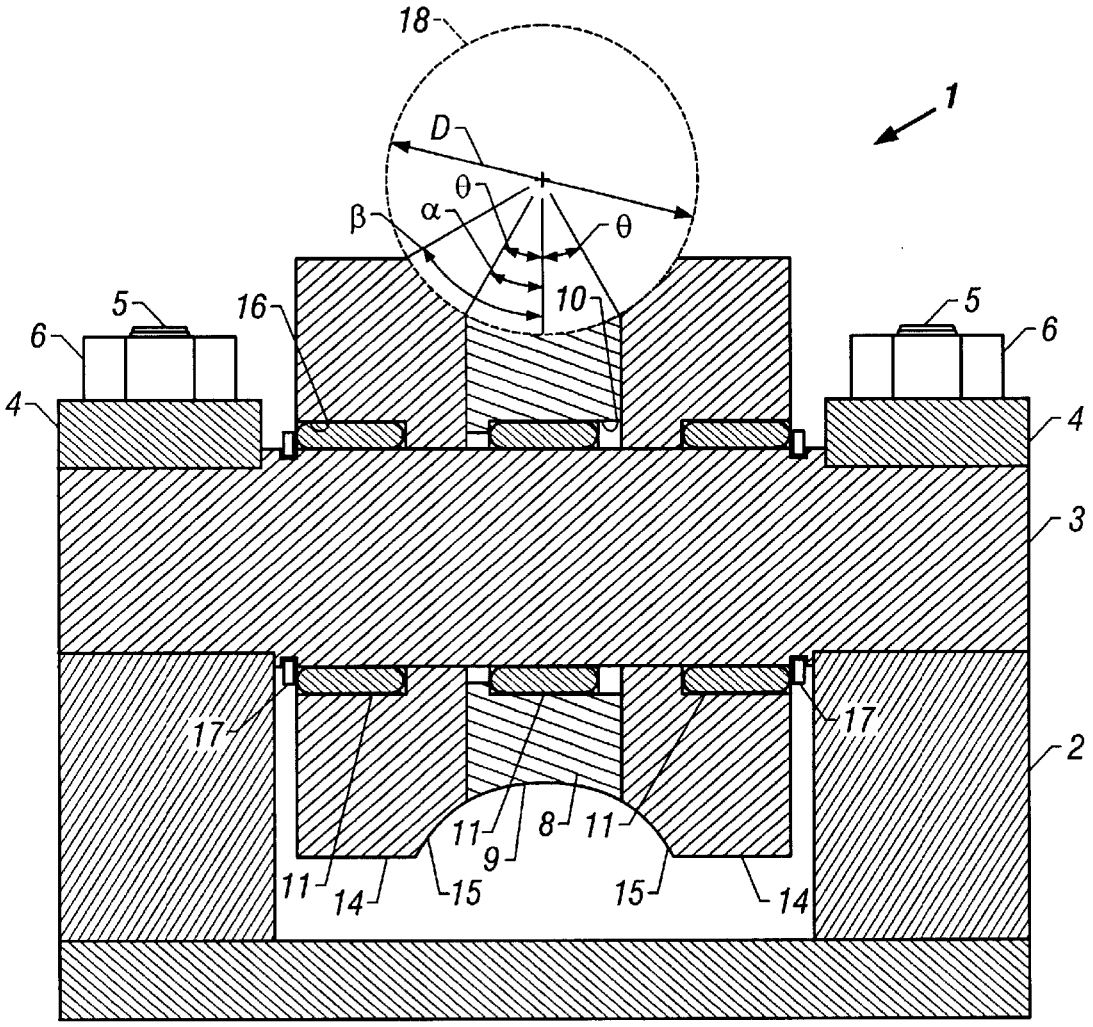
FIG. 2 is a transverse sectional view along the roller shaft axis of the idler roller of FIG. 1.

Referring to FIGS. 1 and 2, one embodiment of this invention is shown as a dead shaft idler roller. Dead shaft idler wheel assembly 1 mounts dead shaft roller assembly 7 on nonrotating dead shaft 3 which is in turn mounted in support frame 2. Support frame 2 consists of an U-shaped base with a flat back which may be welded or bolted to a suitable. structural support and having symmetrical rectangular ends projecting normally from the flat back. Coaxial semicircular grooves which tightly fit to cylindrical dead shaft 3 are centrally located on the outer faces of the support frame 2 both parallel to and opposed to the flat back of support frame. Drilled and tapped holes symmetrically straddling the grooves in the outer faces of support frame 2 and perpendicular to the flat back mount threaded studs 5.

Dead shaft 3 is a symmetrical round bar having a larger diameter central portion which serves as a bearing race and two outboard reduced diameter extensions which can be clamped into support frame 2. At each outer end of the central bearing race portion of dead shaft 3 is an annular snap ring groove. Two identical shaft retainers 4 consist of rectangular bar stock with a central semicircular groove on one side perpendicular to the long axis of the shaft retainer. The semicircular grooves on shaft retainers 4 closely fit dead shaft 3. Perpendicular to and equally offset from the axis of the semicircular groove of shaft retainer 4 are through bolt holes for the studs 5. Dead shaft 3 can be clamped in support frame 2 by mounting shaft retainers 4 over studs 5 and using threaded nuts 6 mounted on studs 5 to force the shaft retainers against the shaft.

Dead shaft roller assembly 7 is rotationally mounted on dead shaft 3 and consists primarily of a center tire 8 and two flanking outside tires 14 with their supporting needle bearings 11. Center tire 8 is an annular ring having an external symmetrical circularly arcuate face 9, transverse ends, and a through bore with a counterbored bearing pocket 10 having a transverse end into which needle bearing 11 may be press-fitted. The generating diameter D of arcuate face 9 corresponds to that of the tubing which will be supported or contacted by center tire 8, while the arc sector of the circularly arcuate face covers an angle θ of approximately 30° to either side of the middle of the arc. The minimum radius of rotation of the center tire 8, denoted by R, occurs in the middle of the arc, while the maximum radius of rotation of the center tire is $R+(D/2)\times(1-\cos\theta)$.

Outside tire 14 is an annular right cylindrical ring with an arcuate face 15 on one side of its outer diameter. The arcuate face 15 of outside tire 14 has its generating circle of the same size as that of arcuate face 9 of center tire 8 so that, when concentric with the arcuate face 9, arcuate face 15 serves as a continuation of arcuate face 9 with only a small clearance gap. The arc for outside tire 14 will cover a sector of approximately 30° to 40°. The minimum rotational radius for outside tire 14 is R+(D/2)×(1−Cos α), while the maximum rotational radius is R+(D/2)×(1−Cos β). The central bore through outside tire 14 is sized to clear dead shaft 3. The central bore is counterbored with a transverse bottom end from the side opposite the arcuate face 15 to form a bearing pocket 16. A needle bearing 11 is press-fitted into bearing pocket 16. One outside tire 14 is mounted on each side of center tire 8 on dead shaft 3 so that, with the exception of a small clearance gap between the outside tire 14 on each side and the center tire, a long continuous arcuate surface is created for contacting the tubing. One snap ring 17 per side is used in the snap ring grooves of dead shaft 3 to aid in retention of the center tire 8 and outer tires 14 on the dead shaft. The outline of the tubing 18 is indicated in FIG. 2 to show how the center tire 8 and outside tires 14 support the tubing.

Figure 3:
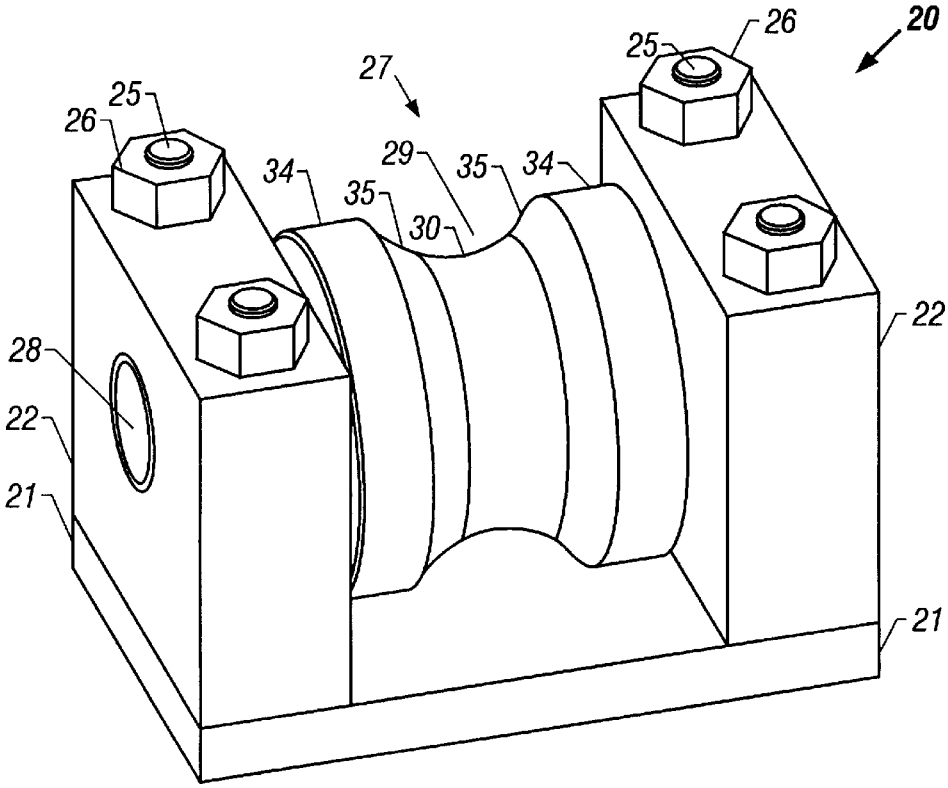
FIG. 3 is an oblique view of another embodiment of an idler roller mounted on a live shaft and using the rollers of this invention.
Figure 4:
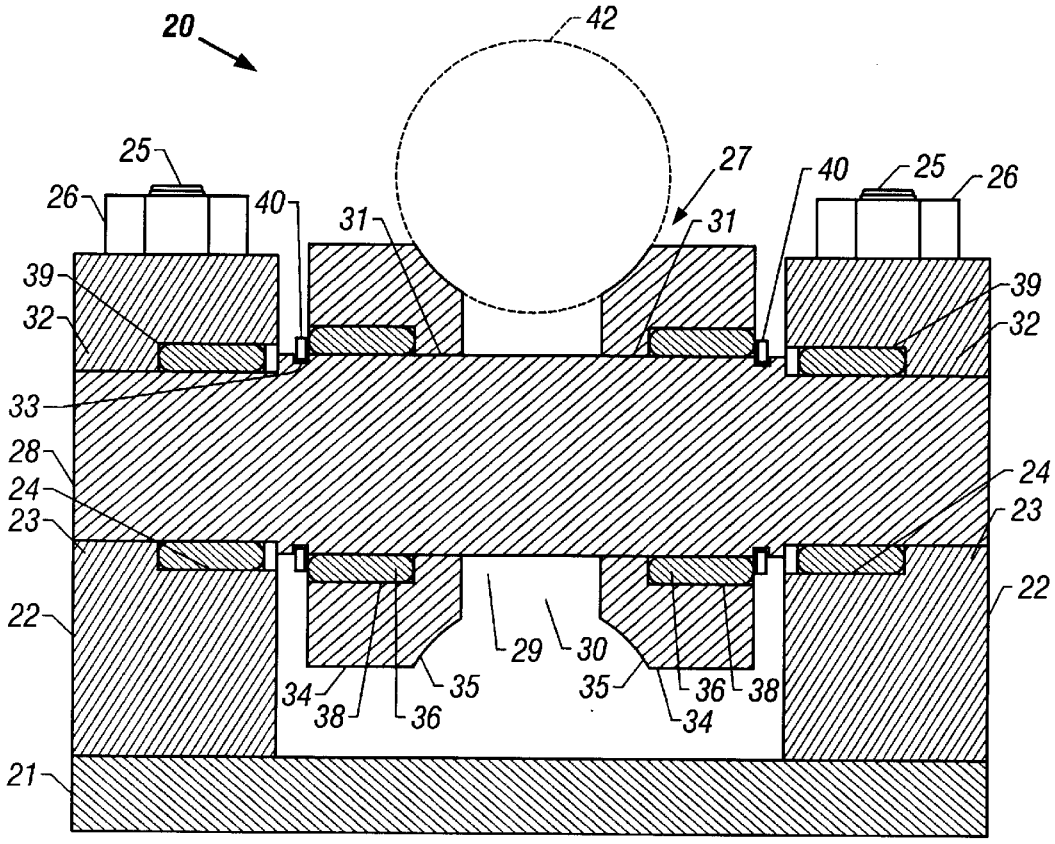
FIG. 4 is a transverse sectional view along the roller shaft axis of the idler roller of FIG. 3.

Another embodiment of this invention is shown as a live shaft idler roller in FIGS. 3 and 4. Live shaft idler wheel assembly 20 mounts live shaft roller assembly 27 in a support frame composed of base plate 21 and two end plates 22. Base plate 21 is rectangular and has a drilled and tapped hole normal to the large upper flat surface of the base plate symmetrically placed near each corner. Base plate 21 may be welded or otherwise attached to a suitable structural support. End plates 22 are rectangular and mounted with their larger flat faces perpendicular to the large upper flat face of base plate 21 and placed in mirror image positions about the middle of the base plate. End plates 22 are provided with vertical through bolt holes placed in their upper surfaces symmetrically about the midplane so that the through holes are coaxial with the tapped corner holes in the base plate 21. Parallel to the base plate and on the vertical center plane of the base plate 21 and the end plates 22 is a through hole 23 with a flat-bottomed bearing pocket counterbore 24 on the inboard side of the end plates 22 when they are mounted on the base plate 21. One stud 25 is threaded into each of the drilled and tapped corner holes of the base plate 21 and is passed through the corresponding coaxial vertical through bolt hole of end plate 22. One nut 26 is used on each stud 25 to clamp end plate 22 to base plate 21.

Live shaft roller assembly 27 consists of live shaft 28 having an integral center tire 29, two mirror-image outer tires 34, and the bearings and snap rings necessary to support the tires and shaft. Live shaft 28 is a symmetrical round bar having an enlarged integral center tire 29 having a circular arcuate face 30, two adjacent larger diameter interior bearing journals 31, and two reduced diameter outer bearing journals 32. The outer ends of live shaft 28 fit loosely in the through bores 23 of end plates 22. At each outer end of the interior bearing journals 31 of live shaft 28 is an annular snap ring groove 33. As is the case for the first embodiment of this invention, the generating diameter D of arcuate face 30 corresponds to that of the tubing which will be supported or contacted by center tire 29, while the arc sector of the circularly arcuate face covers an angle θ of approximately 30° to either side of the middle of the arc in order to provide tubing support. As before, the minimum radius of rotation of the center tire 29, denoted by R, occurs in the middle of the arc, while the maximum radius of rotation of the center tire is R+(D/2)×(1−Cos θ).

Outer tire 34 is an annular right cylindrical ring with an arcuate face 35 on one side of its outer diameter. The arcuate face 35 of outer tire 34 has its generating circle of the same size as that of arcuate face 30 of center tire 29 of live shaft 28 so that, when concentric with the arcuate face 30, arcuate face 35 serves as a continuation of arcuate face 30 with only a small clearance gap. The arc for outer tire 34 will cover a sector of approximately 30° to 40°. As with the previously described embodiment of this invention, the minimum rotational radius for outer tire 34 is R+(D/2)×(1−Cos α), while the maximum rotational radius is R+(D/2)×(1−Cos β). The central bore through outer tire 34 is sized to clear live shaft 28. The central bore is counterbored with a transverse bottom end from the side opposite the arcuate face 35 to form a bearing pocket counterbore 36. An inner needle bearing 38 is press-fitted into bearing pocket 36 and will run on an interior bearing journal 31. One outer tire 34 is mounted on each side of center tire 29 on live shaft 28 so that, with the exception of a small clearance gap between the outer tire 34 on each side and the center tire 29, a long continuous arcuate surface is created for contacting the tubing. An outer bearing 39 is pressed into the bearing pocket counterbore 24 of each of the end plates 22 to support live shaft 28. One snap ring 40 per side is used in the snap ring grooves of live shaft 28 to aid in retention of the outer tires 34 adjacent to the center tire 29 on the live shaft 28. The outline of the tubing 42 is indicated in FIG. 4 to show how the center tire 29 and outside tires 34 support the tubing.

Figure 5:
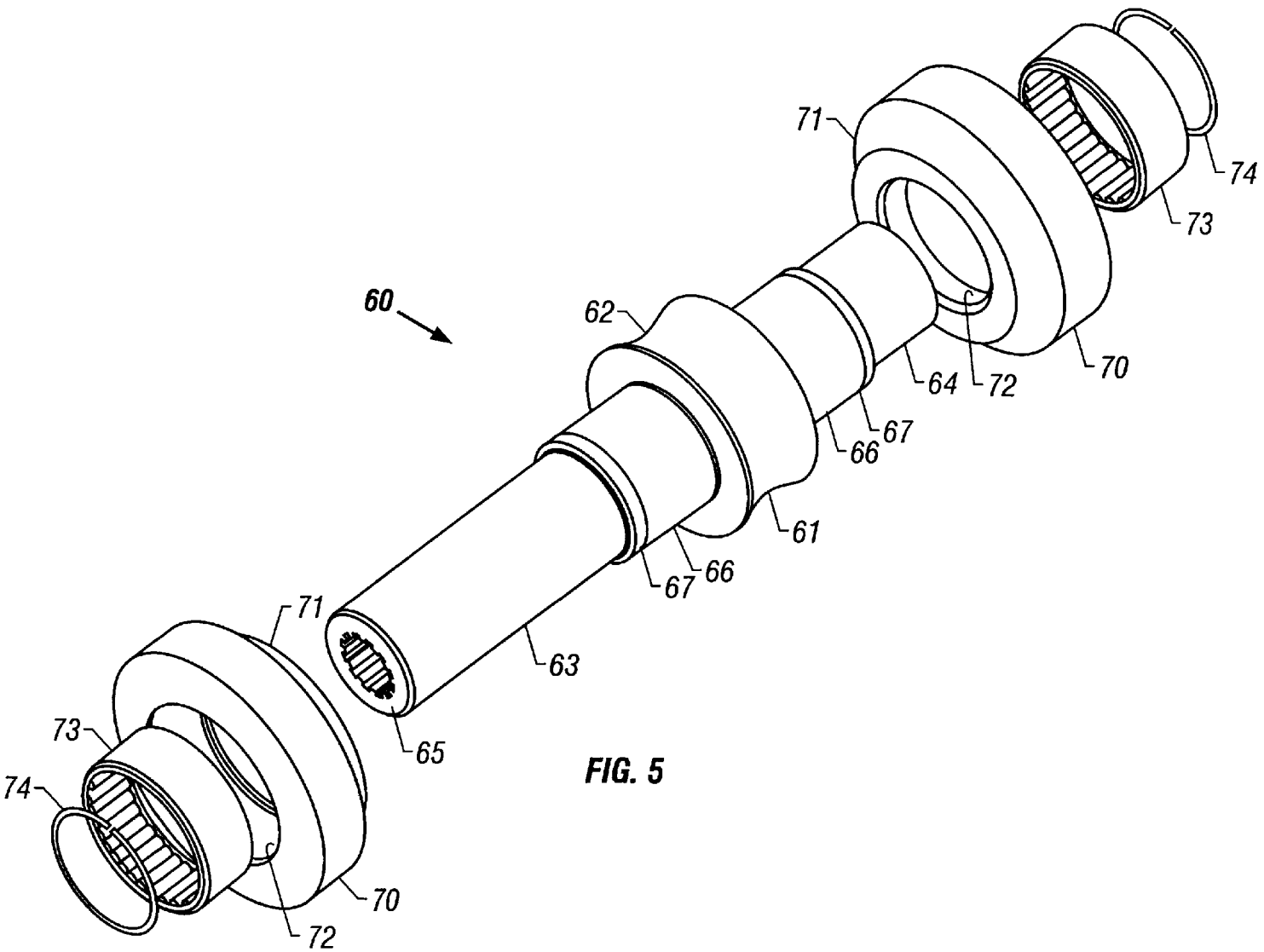
FIG. 5 is an exploded oblique view of yet another embodiment consisting of a drive roller assembly which can be used in the drive modules of an injector.

Yet another embodiment of the invention is a driven roller which is shown in an exploded oblique view in FIG. 5. Driven roller assembly 60 consists of drive roller 61, two identical idler rollers 70, and the needle bearings 73 and snap rings 74 required for assembly. Drive roller 61 has a central integral tire with a symmetrical circular arcuate drive face 62 and with a first outboard bearing journal 63 and second outboard bearing journal 64 of the same diameter at its opposed ends for support in drive module 80 by needle bearings 86. Splined internal socket 65 is mounted on the outer end of first outboard bearing journal 63 for engagement with output shaft 101 of drive motor 100 so that the driven roller assembly 60 may be driven in either direction of rotation. An idler journal 66 of larger diameter than either of the outboard bearing journals 63 and 64 is located on each side adjacent to the central tire of drive roller 61. Located at the outer ends of idler journals 66 and equispaced from the central tire of drive roller 61 are annular snap ring grooves 67. As is the case for the other embodiments of this invention, the generating diameter D of arcuate drive face 62 of drive roller 61 corresponds to that of the tubing which will be supported or contacted by the drive face, while the arc sector of the circularly arcuate face covers an angle θ of approximately 30° to either side of the middle of the arc in order to provide tubing support. As before, the minimum radius of rotation of the center tire of drive roller 61, denoted by R, occurs in the middle of the arc, while the maximum radius of rotation of the center tire is R+(D/2)×(1−Cos θ).

Idler roller 70 is an annular right cylindrical ring with an arcuate support face 71 on one side of its outer diameter. The arcuate face 71 of idler roller 70 has its generating circle of the same size as that of arcuate face 62 of the central tire of drive roller 61 so that, when concentric with the arcuate face 62, arcuate face 71 serves as a continuation of arcuate face 62 with only a small clearance gap. The arc for idler roller 70 will cover a sector of approximately 30° to 40°. As is the case for the other embodiments of this invention, the minimum rotational radius for idler roller 70 is R+(D/2)×(1−Cos α), while the maximum rotational radius is R+(D/2)×(1−Cos β). The central bore through idler roller 70 is sized to clear the idler journals 66 of drive roller 61. The central bore is counterbored with a transverse bottom end from the same side as that with the arcuate face 71 to form a bearing recess counterbore 72. A needle bearing 73 is press-fitted into bearing pocket 72 and will run on an idler bearing journal 66. One idler roller 70 is mounted on each side of the center tire of drive roller 61 so that, with the exception of a small clearance gap between the idler roller 70 on each side and the center tire, a long continuous arcuate surface is created for contacting and supporting the tubing. A snap ring 74 is inserted into each of the two snap ring grooves 67 in drive roller 61 to hold idler rollers 70 in position relative to drive roller 61 so that their arcuate support faces 71 are concentric with that of arcuate drive face 62.

The driven roller assembly 60 shown in FIG. 5 is shown with an injector based on the injector shown in copending U.S. Provisional Patent Application "Coiled Tubing Injector Utilizing Opposed Drive Modules and Having an Integral Bender." This coiled tubing injector is described in FIGS. 6–10.

Figure 6:
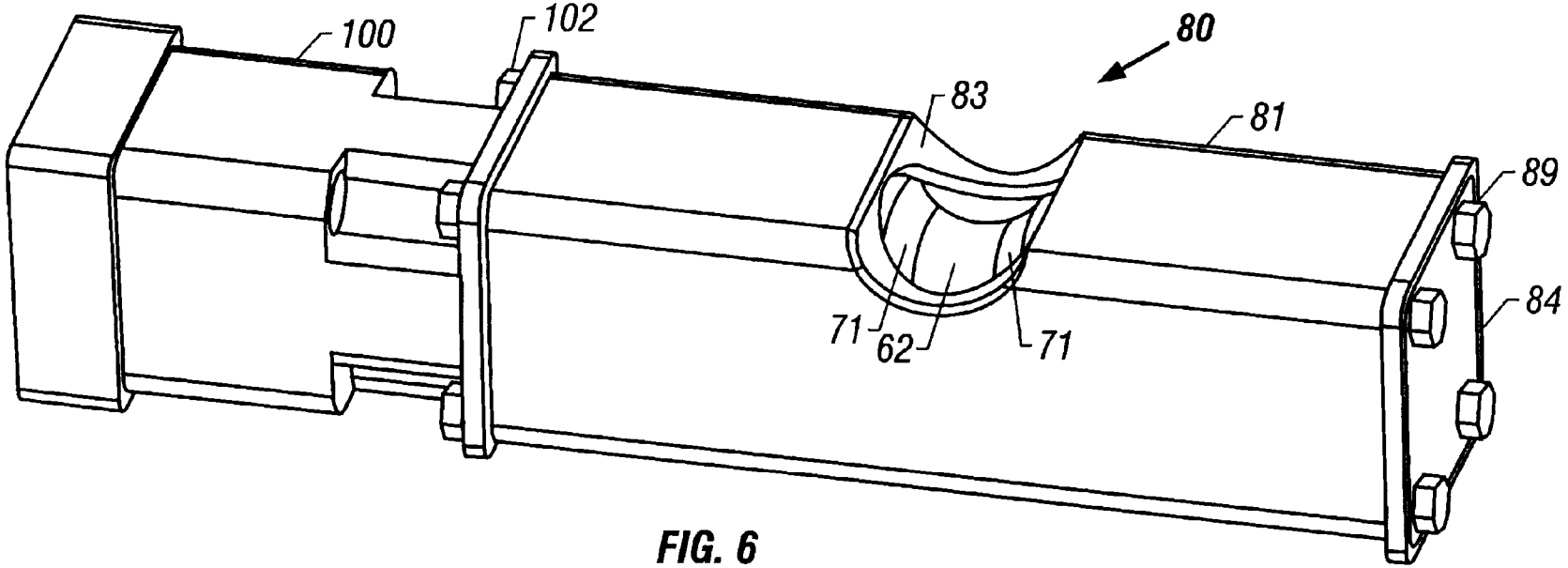
FIG. 6 is an oblique view of a drive module for an injector which utilizes the drive roller assembly of FIG. 5.
Figure 7:
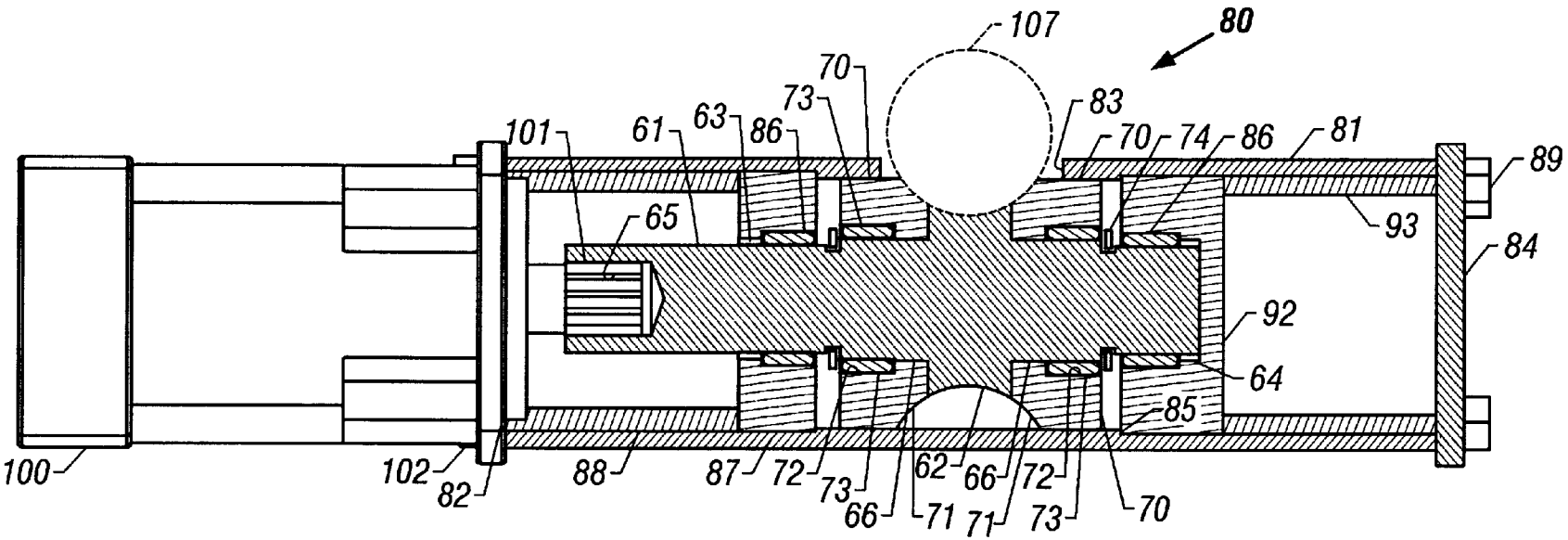
FIG. 7 is a partial longitudinal sectional view of one of the injector drive modules of FIG. 6.

Referring to FIGS. 6 and 7, a drive module 80 based on the driven roller assembly 60 of the third embodiment of this invention is shown. Multiple drive modules 80 are utilized in the coiled tubing injector of copending U.S. Provisional Patent Application filed Jul. 11, 2001, entitled "Coiled Tubing Injector Utilizing Opposed Drive Modules and Having an Integral Bender," which is incorporated by reference herein. Drive module 80 consists of an approximately square cross-section drive module body 81, a hydraulic drive motor 100, and driven roller assembly 60, along with associated hardware. Drive module body 81 is made from a square cross-section bar with radiused corners on the cross-section. Drive module body 81 has a through bore with two mirror-image counterbores having internal transverse shoulders 85. Transverse square motor mount flange 82 is positioned at the first end of drive module body 81. The flange face of motor mount flange 82 is configured to mount drive motor 100 and is appropriately drilled and tapped to receive the motor mounting screws 102. In its middle, drive module body 81 has a transverse arcuate cross-section window 83 cut through two opposed sides and one of their adjoining sides to provide clearance for the tubing when the drive module 80 is positioned adjacent the tubing. Square outer flange 84 is mounted to the transverse second end of drive module body 81 by a comating pattern of drilled and tapped holes near the flange corners by outer flange screws 89. The internal transverse shoulders 85 are located on each side of and adjacent to window 83 in the bore of drive module body 81.

A needle bearing 86 is mounted in each of bearing retainers 87 and 92, which are in turn inserted into drive module body 81 in order to support the driven roller assembly 60 by the first and second outboard bearing journals 63 and 64, respectively, of drive roller 61. First bearing retainer 87, mounted on the drive motor side, is a short right circular cylinder having an on-center through hole larger than the journals of drive roller 61 and, on its side adjacent the driven roller assembly rollers, a counterbore with a transverse shoulder at its bottom. A needle bearing 86 is pressed into the counterbore of first bearing retainer 87 to bear against the transverse shoulder at the bottom of the counterbore. Right circular cylindrical first tubular spacer sleeve 88 is located between drive motor 100 and first bearing retainer 87 within the bore of drive module body 81 to maintain drive roller assembly 60 properly spaced from the motor and axially centered within drive module body 81. The outer, motor end of first tubular spacer sleeve 88 is counterbored to receive the alignment boss of the case of drive motor 100 and thereby align motor 100 within the drive module body 81.

Second bearing retainer 92, mounted outboard of each bearing 86, consists of a short cylinder with a small central through bore having two counterbores on its inner end. The smaller interior counterbore is sized to clear the second outboard bearing journal 64 of drive roller 61 of driven roller assembly 60, while the larger counterbore is sized to mount needle bearing 86. The needle bearing 86 mounted in second bearing retainer 92 supports second outboard bearing journal 64 of drive roller 61 of driven roller assembly 60. Second bearing retainer 92 slip fits into the bore of drive module body 81 with its counterbores facing inwardly and the end of its larger counterbore abutting the end of bearing 86. Right circular cylindrical second tubular spacer sleeve 93 is located between outer flange 84 and second bearing retainer 92 within the bore of drive module body 81 to maintain drive roller assembly 60 properly spaced from the motor and prevent axial play.

Figure 9:
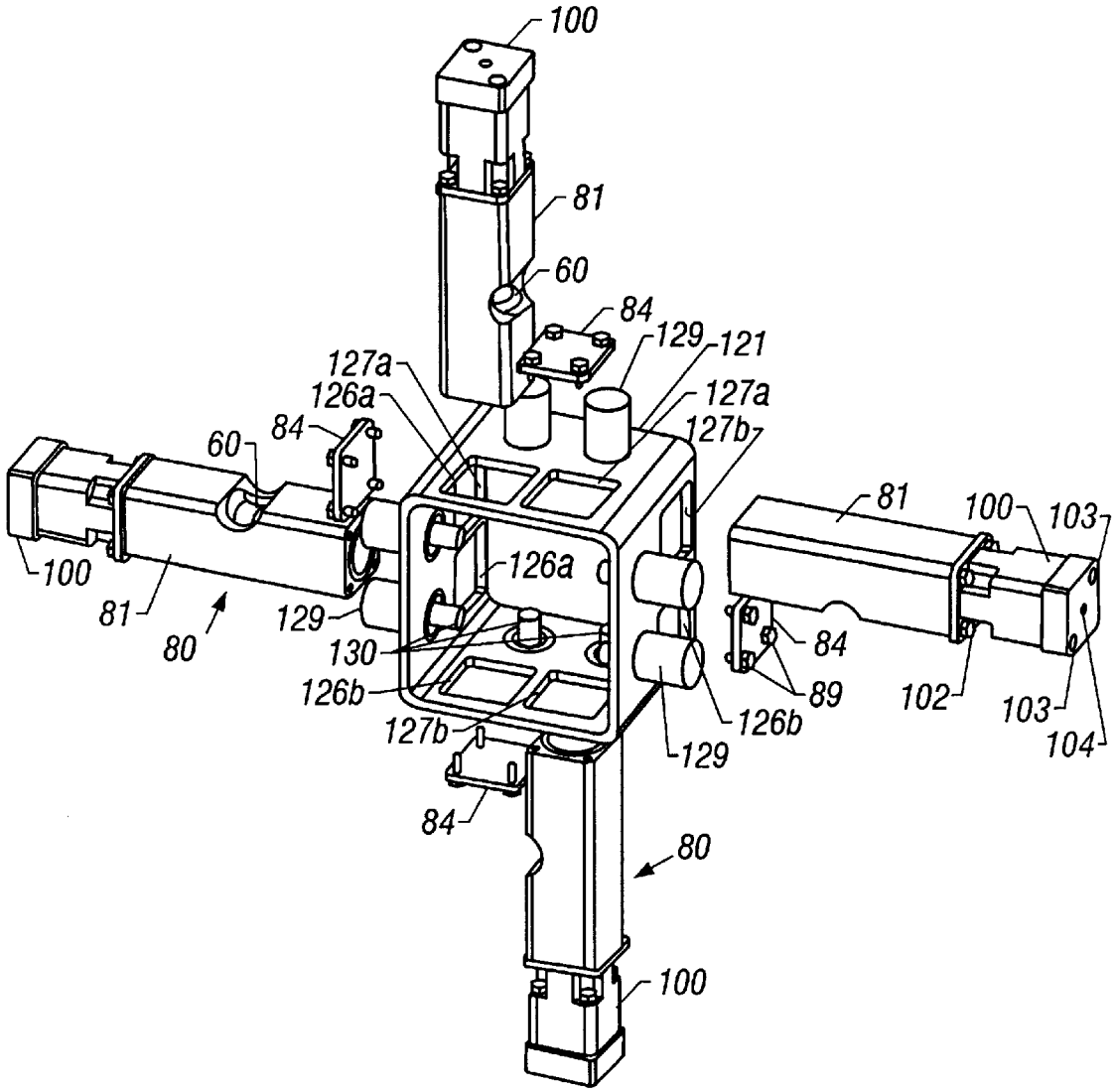
FIG. 9 is an exploded oblique view showing two adjacent drive module pairs and their mounting in a segment of the injector body of FIG. 8.

Drive motor 100 is a small reversible hydraulic motor of gear motor, piston motor, or gerotor construction and with a splined output shaft 101. The output shaft end of the case of drive motor 100 has a short round mounting alignment boss which is mated with the counterbore of first spacer sleeve 88. Drive motor 100 is mounted to motor mount flange 82 of drive module body 81 by motor mount screws 102. Multiple hydraulic ports 103 handle the pressurized fluid supply for drive motor 100, providing operator selectable pressure and return connections. Hydraulic case drain port 104 is also provided on the motor to handle internal leakage as shown in FIG. 9. The position of the tubing is indicated by dashed circle 107 in FIG. 7.

Figure 8:
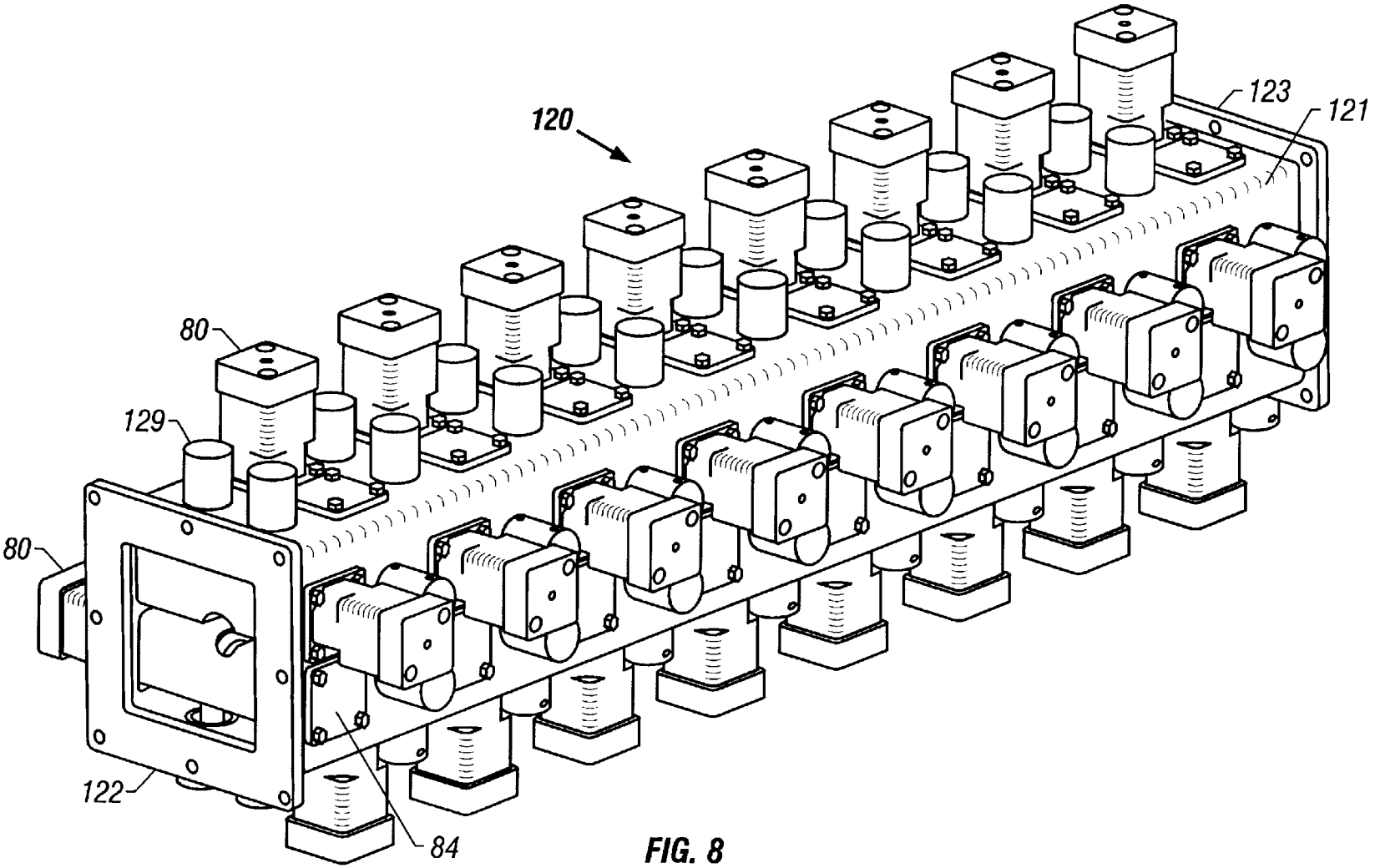
FIG. 8 is an oblique view of a linear injector using the drive roller assembly of FIG. 5.

Referring to FIG. 8, a coiled tubing injector unit 120 for a coiled tubing rig based on the improved driven roller assembly of the third embodiment of this invention is shown in an oblique view. Except for the construction of the driven roller assemblies and their supports, the injector 120 has the same construction as that of the traction unit of copending U.S. Provisional Patent Application "Coiled Tubing Injector Utilizing Opposed Drive Modules and Having an Integral Bender". The tubing is fed substantially coaxially through the injector unit 120 and into the well for performing well operations known to those skilled in the art. Typically the injector is connected sequentially to an adapter spool, blow-out preventers, and the wellhead on its bottom end, while on its top end it may be connected to either a gooseneck or other apparatus. This other hardware is not shown here, but is well known by those skilled in the art of coiled tubing manipulation.

Injector unit 120 consists of traction drive body 121 and multiple drive modules 80 mounted therein. Lower transverse flange 122 at the bottom end and upper transverse flange 123 at the upper end are welded to traction drive body 121 to permit bolting the injector unit to the other hardware which is required. Traction drive body 121 consists primarily of a length of steel square structural tubing approximately 16×16 inches in cross section and having approximately a ⅝ inch wall. It may be seen in FIG. 8 that injector unit 120 has a repetitive array of multiple drive modules 80 extending from each of its four lateral sides. FIG. 9 shows an exploded oblique view of a portion of the injector unit 120 illustrating how traction drive body 121 holds two opposed pairs of drive modules 80. The components shown in FIG. 9 are arrayed in a repetitive pattern up the length of injector unit 120. Identical rectangular coaxial lower and upper drive module ports 126*a,b* and 127*a,b,* respectively, with rounded corners are transversely cut with mirror image symmetry about a longitudinal midplane of symmetry of traction drive body 121 to mount each opposed pair of drive modules 80. Ports 126*a,b* and 127*a,b* are elongated slightly in the direction normal to the midplane plane of symmetry.

In the same transverse plane containing ports 126*a,b* and 127*a,b* but normal to the aforementioned longitudinal midplane are two pairs of coaxial threaded squeeze cylinder mount holes 128 which are used to threadedly mount two pairs of opposed, inwardly looking hydraulic squeeze cylinders 129. The holes 128 are symmetrical about the centerline of traction drive body 121.

Figure 10:
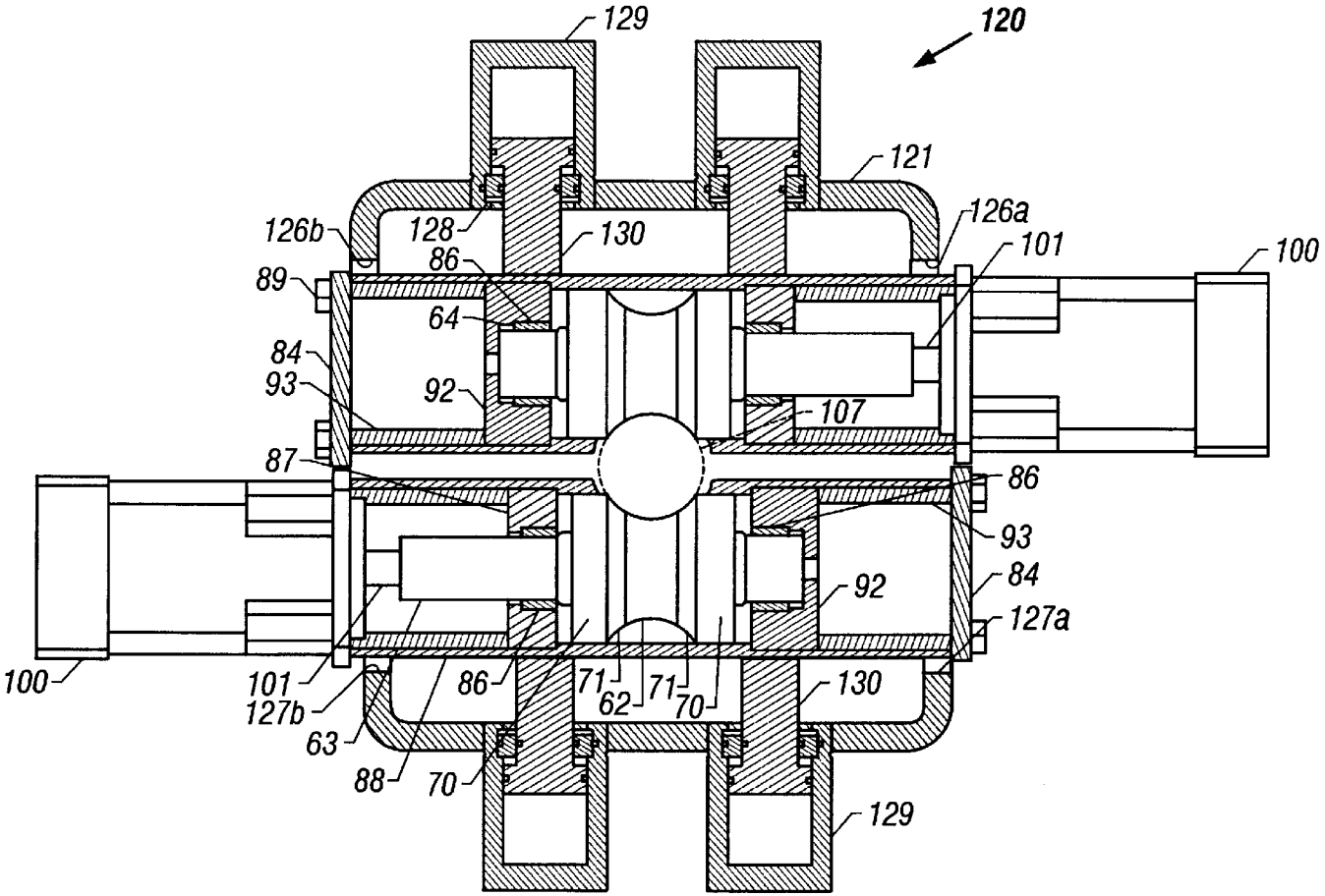
FIG. 10 is a partial, nonexploded transverse cross-sectional view of the segment of the housing of the injector corresponding to FIG. 9 and showing an opposed drive module pair installed in the housing.

Short-stroke double-acting squeeze cylinders 129 each have a male thread on the rod end of their stub cylindrical bodies and are threaded into mount holes 128. The squeeze cylinders may be seen more clearly in FIG. 10. Each cylinder 129 has a piston rod 130 which has a flat outer end. Although it is not shown here, a cylinder bias spring may be mounted internally to squeeze cylinder 129 in order to bias rod 130 to extend. Such a bias spring is disclosed in copending U.S. Provisional Patent Application "Coiled Tubing Injector Utilizing Opposed Drive Modules and Having an Integral Bender". Adjacent a first opposed pair of drive module ports 126*a,b* and 127*a,b* and its associated cylinder mount holes 129 is a similar arrangement of ports and cylinder mount holes which has its midplane of symmetry rotated 90° relative to the first set. These ports 126*a,b* and, similarly, 127*a,b* are configured to accept axial insertion and mounting therein of drive modules 80. For clearance reasons, the drive modules 80 may be inserted from opposite directions into ports 126*a,b* and 127*a,b,* as is shown in FIGS. 8, 9, and 10. When drive modules 80 are being inserted into the mounting ports in traction drive body 121, piston rods 130 of squeeze cylinders 129 are retracted. Cylinders 129 are positioned to urge drive modules 80 toward the centerline of traction drive body 121 so that the driven roller assemblies of the drive modules 80 can transversely contact any coiled tubing which is deployed through the injector unit 120. Alternatively, one or both of the cylinders 129 can be replaced by one or more springs for urging the drive modules 80 toward the centerline of traction drive body 121 causing the drive modules to grip the tubing.

Operation of the Invention

The first embodiment of the invention can be used as an idler roller, a guide roller, or as a hold-down roller. In service, the dead shaft idler wheel assembly 1 is positioned so that the arcuate faces 9 and 15 of, respectively, the center tire 8 and the two outside tires 14 are in contact with the tubing 18 and exerting normal force on the tubing. As the coiled tubing injector moves the tubing by the roller, the tangential friction between the tires of the roller segments and the tubing cause the tires 8 and 14 to independently rotate on their bearings 11 about dead shaft 3. All three tires 8 and 14 of the dead shaft roller assembly contribute to the lateral support of the tubing cross-section so that ovaling tendencies are minimized.

The operation of the first embodiment of the improved rollers of this invention, using a non-rotating dead shaft, benefits significantly from the separation of the arcuate surface of the dead shaft roller assembly 7 into independently rotating segments. The effective radius of curvature of the axis of any tubing 18 contacting the roller assembly 7 is substantially larger than the rotational radius of any portion of the roller arcuate faces 9 and 15, so some rubbing due to differential movement in the axial direction will result. For practical purposes, the radius of curvature of the tubing may be assumed to be infinite; i.e., the tubing is straight. If the roller shown in FIG. 2 were integrated and not segmented, then the smallest rotational radius of the integrated roller would be R, while the largest would be $R+(D/(D/2)\times(1-\cos\beta)$, where $\beta$ is the effective half-angle of the contact arcuate face. The effective radius of rotation, $R_E$, the radius of the integrated roller which would have no relative slippage or rubbing with the tubing, would then lie somewhere between the smallest and largest rotational radius. Thus, the maximum amount of relative axial motion of the contacting integrated roller and the tubing would occur where the largest value of the difference between $R_E$ and the rotational radius of the arc occurs. This difference and the attendant maximum rubbing action between the tubing and the roller could thus be quite large and objectionable. By segmenting the roller, as is done for dead shaft roller assembly 7, effective radius of rotation $R_{E1}$ for the arcuate face 9 of center tire 8 lies between R and $R+(D/2)\times(1-\cos\theta)$. Likewise, for arcuate face 15 of outside tire 14, effective radius of rotation $R_{E2}$ lies between $R+(D/2)\times(1-\cos\alpha)$ and $R+(D/2)\times(1-\cos\beta)$. The maximum amounts of rubbing are related to the maximum differences between $R_{E1}$ and any point on the rotational radius of arcuate surface 9 of center tire 8 and $R_{E2}$ and any point on the rotational radius of arcuate surface 15 of outside tire 14. Therefore the rubbing for a segmented roller such as dead shaft roller assembly 7 is necessarily reduced relative to a non-segmented roller because arcuate face half-angles $\alpha$ and $\theta$ are both less than $\beta$ and the possible range of rotational radius differences are accordingly reduced.

The application and operation of the second embodiment of this invention, the live shaft idler wheel assembly 20, is very similar to that of the dead shaft idler wheel assembly 1. The live shaft idler wheel assembly 20 embodiment of the invention can be used as an idler roller, a guide roller, or as a hold-down roller. In service, the live shaft idler wheel assembly is positioned so that the arcuate faces 30 and 35 of, respectively, the integral center tire 29 of live shaft 28 and the two outer tires 34 are in contact with the tubing 42 and exerting normal force on the tubing. As the coiled tubing injector moves the tubing by the roller, the tangential friction between the tires of the roller segments and the tubing cause the tires to independently rotate on their bearings 39 about live shaft 28, while live shaft 28 rotates within its bearings 38. All three arcuate faces 30 and 35 contribute to providing lateral support to the tubing 42 so that ovaling of the tubing is minimized. Since the same arcs and radii are used for each of the corresponding arcuate faces of the live shaft idler roller assembly 27 as for the dead shaft roller assembly 7 of the first embodiment and both embodiments have independent rotation of the roller segments, the rubbing tendencies of the described embodiments are identical.

The application and operation of the driven roller assembly 60 is very similar to those of the dead shaft idler wheel assembly I and the live shaft idler wheel assembly 20. The driven roller assembly 60 embodiment of the invention can be used as a powered idler roller, a powered guide roller, a powered hold-down roller, or as a drive roller in a coiled tubing injector. In service, the driven roller assembly is positioned so that the arcuate faces 62 and 71 of, respectively, the integral center tire of drive roller 61 and the two idler rollers 70 are in contact with the tubing and exerting normal force on the tubing. Drive roller 61 is supported by needle bearings 86 of the drive module 80. When torque is applied to drive roller 61 through splined internal socket 65 by motor 100 of drive module 80, friction and the normal force between arcuate drive face 62 and the tubing permit drive roller to exert tangential drive forces on the tubing in the direction of the tubing axis. As the coiled tubing moves by the driven roller assembly, the tangential friction between the arcuate faces 71 of the roller segments and the tubing cause the idler rollers 70 to independently rotate on their bearings 73 about idler journals 66. All three arcuate faces 62 and 71 contribute to providing lateral support to the tubing 107 so that ovaling of the tubing is minimized. Since the same arcs and radii are used for each of the corresponding arcuate faces of the driven roller assembly 60 of the drive module 80 as for the dead shaft roller assembly 7 of the other embodiment and both embodiments have independent rotation of the roller segments, the rubbing tendencies of the embodiments are identical.

The operation of a coiled tubing injector 120 using the improved rollers of the present invention is similar in many respects to that of conventional coiled tubing injectors in that it both inserts and withdraws coiled tubing from a well. However, certain critical differences exist between this device and both track-type and wheel-type injectors, as will be described below.

In order to feed tubing into the unit during initial loading, the hydraulic squeeze cylinders 129 of the injector unit 120 are pressurized to respectively permit moving their respective drive modules 80 away from the centerline path for the tubing. For squeeze cylinders 129, the rods 130 are retracted so that the drive modules 80 can easily be displaced laterally within their lower 126*a,b* and upper 127*a,b* drive module ports to permit tubing passage. At this point, tubing can be fed through the injector unit 120 and thence into the blowout preventers and the well.

After the tubing is deployed through the units of the injector 120 and the tubing path has been inspected to ensure proper centralization, the squeeze cylinders 129 can be pressurized to extend their piston rods 130 to press on their respective drive modules 80. This hydraulic inward biasing of the drive modules 80 results in the simultaneous and uniform gripping of the tubing between the opposed sets of driven roller assemblies 60. The uniformity of squeeze by the driven roller assemblies 60 is ensured by manifolding all of the squeeze cylinders 129 together.

When driving the tubing in either direction, the appropriate ports 103 of the individual hydraulic drive motors 100 are selectably simultaneously pressurized to initiate their rotation and that of the attached driven roller assemblies 60 in the desired direction. The motors 100 are manifolded together, so only one control valve is required to actuate and control the injector unit 120. For clarity, the interconnecting hydraulic tubing and the hydraulic system components are not shown, but these items are well known to those skilled in the art. Because squeeze cylinders 129 exert a substantial normal load on the tubing from the driven roller assemblies 60, the frictional shear required between drive rollers 61 and the tubing in order to modify the axial force on the tubing can be developed. Since the tubing is well supported around its circumference by any opposed set of driven roller assemblies 60 and likewise is supported on a different axis rotated 90° apart by the adjacent sets of driven roller assemblies 60 on either side, ovalization of the tubing is minimized. At the same time, the segmentation of the driven roller assembly 60 results in much reduced tubing rubbing, so that the rollers and tubing both wear less.

Advantages of the Invention

Both the first embodiment dead shaft idler wheel assembly 1 and the second embodiment live shaft idler wheel assembly 20 can be used very satisfactorily as either guide rollers or as hold-down rollers for coiled tubing injection and handling systems. These particular applications of rollers are associated with large transverse loads being applied to the tubing, with an increasing tendency for tubing ovaling under the lateral load when the load is increased. Likewise, the tendency for rubbing is increased with increasing roller lateral load. A highly loaded non-segmented roller cannot have both a small radius of rotation R and a large half-angle of support β without causing very severe rubbing. However, the improved segmented rollers of this invention can simultaneously provide both large half-angles of support β for avoiding ovalization of the tubing and high transverse load capacities with a small radius of rotation R without severe rubbing. The ability to use smaller rollers than would otherwise be possible without this invention permits downsizing coiled tubing equipment based on these rollers, with associated weight and cost reductions. These same advantages pertain to the driven roller assembly 60.

The injector of copending provisional Patent Application Serial No. 60/304,681 filed Jul. 11, 2001 offers several important advantages over conventional tubing injectors when it is used with the rollers of this invention. A very significant advantage is the relatively small size and weight of the injector. This feature is important for areas where significant weight limits are placed on vehicles. Another advantage is the modularity of the unit, which leads to fabrication savings, inventory minimization, and improved serviceability. Assembly and disassembly are both very simple for this construction, so the changing out of drive modules is easy and rapid. The use of multiple drive modules also adds a high level of redundancy to the system, thereby improving its reliability.

A further advantage is that load sharing of the drive modules is improved. For both conventional track-type injectors and wheel injectors, some slippage or tubing strain must occur because the strain in the tube builds in the direction of increasing tension, while for both track and wheel injectors, the strain in the track or wheel builds in the opposite direction. In the case of the injector of this invention, the individual roller contact patches on the tubing are relatively small and there is less influence of this effect. The alternation of tubing support directions by the drive rollers aids in avoiding ovaling of the tubing under side loads. This basically full support of the tubing is highly desirable for improving tubing life.

These and other advantages will be obvious to those skilled in the art. It may be understood readily that certain detail changes from the design herein are still within the scope of this invention. In particular, different types or combinations of bearings may be more suitable for supporting the tires, idlers, and rollers of the different embodiments. While the needle bearings shown offer good radial load capacity, they are limited in axial thrust capacity. Accordingly, bearings more suited to providing both radial load and thrust load capability may be substituted for the needle bearings. Alternately, separate thrust bearings may be used to bear on the outside transverse ends of the idlers to absorb the unbalanced axial thrust loads while the needle bearings are used to support the radial loads.

What is claimed is:

1. A roller assembly for supporting and applying transverse loads to tubing during its injection into and withdrawal from a wellbore comprising:

a central roller having a primary circumferential groove with a circularly arcuate cross-section;

a first outer roller having a first annular surface having a secondary circumferential groove with a circularly arcuate cross-section on an inner side of said first outer roller, said secondary groove adjacent a first side of the central roller; and a second outer roller having a second annular surface having a tertiary circumferential groove with a circularly arcuate cross-section on an inner side of said second outer roller, said tertiary groove adjacent a second side of the central roller;

wherein the central roller and the first and second outer rollers are independently rotatable coaxial rollers, the primary, secondary and tertiary grooves having the same arc diameter and being mutually concentric to form a substantially continuous circularly arcuate tubing contact surface.

2. The apparatus of claim 1, wherein the primary groove extends about 60°.

3. The apparatus of claim 1, wherein the secondary and tertiary grooves extend from about 30° to about 40°.

4. The apparatus of claim 1, wherein the arc diameter of the primary groove is substantially equal to a diameter of a length of coiled tubing supported by the roller assembly.

5. The apparatus of claim 1, further comprising a central non-rotating shaft passing through a through-bore in the central roller and the first and second outer rollers, wherein the independently rotatable central roller and outer rollers are supported by said shaft and rotatable about said shaft.

6. The apparatus of claim 1, further comprising a central rotating shaft passing through a through-bore in the central roller and the first and second outer rollers, wherein the central roller is integral with the rotatable shaft and rotates with the rotatable shaft and the outer rollers are independently rotatable about the rotatable shaft.

7. The apparatus of claim 6, wherein the central roller and the rotating shaft are rotationally driven by a motor.

8. An apparatus for supporting and applying transverse loads to coiled tubing during its injection into and withdrawal from a wellbore comprising:

a central roller having a primary circumferential groove with a circularly arcuate cross-section; and a first and second mirror-image cylindrical outer rollers, said first and second outer rollers having respectively a secondary and tertiary circumferential groove with a circularly arcuate cross-section an arcuate surface on a internal side of an outer diameter of said first and second outer rollers, one outer roller situated on each side of the central roller with the internal side facing the central roller and having a small clearance gap between the central roller and the outside rollers;

wherein the central roller and the outer rollers are independently rotatable coaxial rollers, the primary, secondary and tertiary grooves having the same arc diameter and being mutually concentric to form a substantially continuous circularly arcuate tubing contact surface;

whereby when coiled tubing is placed in the circularly arcuate tubing contact surface, the movement of the coiled tubing will independently rotate the central and outer rollers.

9. The apparatus of claim 8, further comprising a central non-rotating shaft passing through a through-bore in the central roller and the outer rollers, wherein the independently rotatable central roller and outer rollers are supported by said shaft and rotatable about said shaft.

10. The apparatus of claim 8, further comprising a central rotating shaft passing through a through-bore in the central roller and the outer rollers, wherein the central roller is integral with the rotatable shaft and rotates with the rotatable shaft and the outer rollers are independently rotatable about the rotatable shaft.

11. The apparatus of claim 10, wherein the central roller and the rotating shaft are rotationally driven by a motor.

12. The apparatus of claim 8, wherein the primary groove is symmetrical about a midplane transverse to the roller axis and each side of the groove extends about 30° from the middle.

13. The apparatus of claim 8, wherein the secondary and tertiary grooves extend from about 30° to 40°.

14. The apparatus of claim 8, wherein the arc diameter of the primary groove is substantially equal to a diameter of a length of coiled tubing supported by the tubing contact surface.

15. A method for supporting and applying both transverse and longitudinal loads to coiled tubing during its injection into and withdrawal from a wellbore comprising:

(a) feeding a coiled tubing through a functional path of a coiled tubing injector, said coiled tubing in contact with a plurality of roller assemblies, each roller assembly having a central roller and a first and a second roller each having a grooved surface with a circularly arcuate cross-section, wherein the central roller and the first and second outer rollers are independently rotatable coaxial rollers, the grooved surfaces of the central, the first and the second outer rollers having the same arc diameter and being mutually concentric to form a substantially continuous circularly arcuate tubing contact surface; and (b) operating the coiled tubing injector to cause said roller assemblies to bear transversely on the coiled tubing so that tangential friction is developed between said rollers and the tubing, thereby permitting longitudinal driving forces to be transferred from the rollers to the tubing when the central rollers of the roller assemblies are rotationally driven;

whereby when the coiled tubing moves by the circularly arcuate tubing contact surface the tangential friction between the rollers and the tubing cause the first and second outer rollers to independently rotate.

16. The method of claim 15, wherein the roller assembly further comprising a central rotating shaft passing through a through-bore in the central roller and the first and second outer rollers, wherein the central roller is integral with the rotatable shaft and rotates with the rotatable shaft and the outer rollers are independently rotatable about the rotatable shaft.

17. The method of claim 16, wherein the central roller and the rotating shaft are rotationally driven by a motor.

18. A method for supporting and applying both transverse and longitudinal loads to coiled tubing during its injection into and withdrawal from a wellbore comprising:

(a) feeding a coiled tubing through a functional path of a coiled tubing injector, said coiled tubing in contact with a roller assembly comprising:

a central roller having a primary circumferential groove with a circularly arcuate cross-section;

a first outer roller having a first annular surface having a secondary circumferential groove with a circularly arcuate cross-section on an inner side of an outer diameter of said first outer roller, said secondary groove adjacent a first side of the central roller; and a second outer roller having a second annular surface having a tertiary circumferential groove with a circularly arcuate cross-section on an inner side of an outer diameter of said second outer roller, said tertiary groove adjacent a second side of the central roller;

wherein the central roller and the outer rollers are independently rotatable coaxial rollers, the primary, secondary and tertiary grooves having the same arc diameter and being mutually concentric to form a substantially continuous circularly arcuate tubing contact surface;

(b) adjusting the tangential friction between the rollers and the coiled tubing;

(c) engaging the coiled tubing injector to move the coiled tubing by the circularly arcuate tubing contact surface;

whereby when the coiled tubing moves by the circularly arcuate tubing contact surface the tangential friction between the rollers and the tubing cause the rollers to independently rotate.

19. The method of claim 18, wherein the tangential friction between the rollers and the coiled tubing is hydraulically adjusted.

20. The method of claim 19, where the tangential friction between the rollers and the coiled tubing is manually adjusted.

* * * * *